US010810931B2

(12) United States Patent
Miller et al.

(10) Patent No.: US 10,810,931 B2
(45) Date of Patent: Oct. 20, 2020

(54) DISCRETE LED DISPLAY CONTROL

(71) Applicant: The Goodyear Tire & Rubber Company, Akron, OH (US)

(72) Inventors: Joshua Alan Miller, Mogadore, OH (US); William Anthony Hoyt, Perrysburg, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 16/056,859

(22) Filed: Aug. 7, 2018

(65) Prior Publication Data

US 2020/0051488 A1 Feb. 13, 2020

(51) Int. Cl.
*G09G 3/32* (2016.01)

(52) U.S. Cl.
CPC ..... *G09G 3/32* (2013.01); *G09G 2320/0646* (2013.01); *G09G 2320/0693* (2013.01); *G09G 2330/021* (2013.01); *G09G 2360/16* (2013.01); *G09G 2380/12* (2013.01)

(58) Field of Classification Search
CPC .. G09G 5/00; G09G 3/34; G09G 5/10; G09G 2360/16; G09G 2320/062
See application file for complete search history.

(56) References Cited

U.S. PATENT DOCUMENTS 5,532,711 A 7/1996 Harris ..... G90G 3/34
7,202,613 B2 4/2007 Morgan et al. ..... H05B 37/00
7,495,576 B2 * 2/2009 Maskeny ..... G09G 3/32 340/815.4
7,817,171 B2 * 10/2010 Shiomi ..... G09G 3/3607 345/690
8,081,141 B2 12/2011 Thiele et al. ..... G09G 5/00
9,041,309 B1 5/2015 Shane ..... G05F 1/00
9,084,314 B2 7/2015 Conover et al. ..... H05B 37/029
9,378,682 B2 * 6/2016 Lim ..... G09G 3/3291
9,928,781 B2 * 3/2018 Kamiyamaguchi .. G09G 3/3241
2002/0030647 A1 * 3/2002 Hack ..... G09G 3/3233 345/82
2004/0201582 A1 * 10/2004 Mizukoshi ..... G09G 3/3233 345/211
2005/0046739 A1 * 3/2005 Voss ..... H04N 5/2354 348/371
2006/0220578 A1 * 10/2006 Park ..... G09G 3/3225 315/169.3

(Continued)

*Primary Examiner* — William Lu
(74) *Attorney, Agent, or Firm* — Edward T. Kennedy

(57) ABSTRACT

A discrete LED display control includes a method of scaling the brightness of frames of an image according to corresponding electrical current requirements. The method includes opening an electronic file containing a frame of an image to be shown on the display and measuring a commanded brightness for each pixel of the frame of the image. Brightness values of the commanded brightnesses are summed and converted to corresponding current values. The corresponding current values are adjusted to arrive at a total estimated current for the frame of the image. If the total estimated current exceeds a current limit of the display, the brightness value of each pixel is scaled to a final brightness value. The final brightness value corresponds to an adjusted current that is within the current limit. The adjusted current that corresponds to the final brightness value is sent to the display.

13 Claims, 4 Drawing Sheets

(56) References Cited

U.S. PATENT DOCUMENTS

| | | | | |
|---|---|---|---|---|
| 2007/0008297 | A1* | 1/2007 | Bassetti | G09G 3/3233 345/173 |
| 2008/0278433 | A1* | 11/2008 | Lee | G09G 3/344 345/107 |
| 2009/0174634 | A1* | 7/2009 | Kohno | G09G 3/3233 345/84 |
| 2011/0058074 | A1* | 3/2011 | Kimura | H04N 9/30 348/243 |
| 2011/0254871 | A1* | 10/2011 | Yoo | G09G 3/3233 345/690 |
| 2012/0218283 | A1* | 8/2012 | Ishii | H04N 9/3111 345/589 |
| 2013/0027279 | A1* | 1/2013 | Peacock | G06F 3/1446 345/1.3 |
| 2013/0127369 | A1 | 5/2013 | Campbell et al. | H05B 33/08 |
| 2013/0236091 | A1* | 9/2013 | Ubillos | H04N 9/70 382/163 |
| 2013/0271356 | A1* | 10/2013 | Yoshida | H04N 9/67 345/88 |
| 2014/0091715 | A1* | 4/2014 | Tada | H05B 45/20 315/153 |
| 2014/0152704 | A1* | 6/2014 | Jeong | G09G 3/3233 345/690 |
| 2016/0027365 | A1* | 1/2016 | Kempf | G09G 3/2003 345/690 |
| 2017/0124930 | A1* | 5/2017 | Ortega | G09G 3/006 |
| 2019/0080669 | A1* | 3/2019 | Li | G09G 5/10 |

* cited by examiner

| Row | Column 1 Brightness | | | Column 2 Brightness | | | ... | Last Column Brightness | | |
|---|---|---|---|---|---|---|---|---|---|---|
| | Red | Green | Blue | Red | Green | Blue | | Red | Green | Blue |
| 1 | 254 | 254 | 254 | 254 | 254 | 254 | | 254 | 254 | 254 |
| 2 | 10 | 10 | 10 | 10 | 10 | 10 | | 10 | 10 | 10 |
| 3 | 60 | 60 | 60 | 60 | 60 | 60 | | 60 | 60 | 60 |
| 4 | 30 | 30 | 30 | 30 | 30 | 30 | | 30 | 30 | 30 |
| 5 | 10 | 10 | 10 | 10 | 10 | 10 | | 10 | 10 | 10 |
| ... | | | | | | | | | | |
| Last Row | 100 | 100 | 100 | 80 | 80 | 80 | | 90 | 90 | 90 |
| Sum | 10000 | 15000 | 12000 | 10000 | 15000 | 12000 | | 10000 | 15000 | 12000 |

| | Red | Green | Blue |
|---|---|---|---|
| Pixel Color Brightness Sums | 14000000 | 21000000 | 16000000 |
| Converted from Brightness to Current | 140.0 | 210.0 | 160.0 |
| Calibrated by R,G,B Parameters | 126.0A | 189.0A | 144.0A |
| Total Estimated Current | | 459.0A | |

DISCRETE LED DISPLAY CONTROL

FIELD OF THE INVENTION

The invention relates to electronic displays, and to LED displays. More particularly, the invention relates to control of discrete LED displays. Specifically, the invention is directed to a discrete LED display control that includes a method of scaling the brightness of frames of an image according to corresponding electrical current requirements.

BACKGROUND OF THE INVENTION

Images are often shown on electronic displays, such as light-emitting diode (LED) displays. LED displays require varying amounts of electrical power to operate, and the amount of power typically depends on the image being shown on the display. For example, brighter images and images that use a larger area of the display require more electrical current than dimmer images and images that use a smaller area of the display.

For an LED display that is a discrete unit, such as a display that is mounted on a vehicle such as an airship and operates while on the vehicle, the power supply is an important consideration. The power supply for a vehicle-mounted discrete LED display is important because the vehicle has a limited electrical current available for the display, and this limit cannot be exceeded.

Over time, LED displays have become capable of showing advanced images, such as sophisticated graphics, video files and live video feeds. However, the limited electrical current available on a vehicle has created performance issues when such images are to be shown on a vehicle-mounted discrete display. For example, when an image or series of images requires more current than is available for the display, such as an image requiring 200 amps of electric current when only 150 amps are available, the display might not function.

A prior art technique that was developed to address such issues includes performing a scan of the electronic file containing the image or series of images which will be shown on the display, such as a video file. The maximum current required to show the file on the display is then estimated. If the electronic file requires more current than is available on the display, the brightness values of the files are manually reduced to ensure that the required current is below the maximum available current. This technique involves significant pre-planning and execution steps, as each file must manually be reviewed, potentially altered for brightness, and re-reviewed. As a result, it is extremely difficult to employ this prior art technique when the LED display is being updated in real time, such as at a live event, or when the LED display is to show multiple images.

In addition, because the prior art technique involves manual review and adjustment of file brightness values, the brightness of the image or video files may be cut well below what may actually be needed to ensure the required current is below the maximum available current. Such excessive reduction may lead to a darker-than-optimum image being shown on the display, which is undesirable.

As a result, it is desirable to develop a control system and/or method for a discrete LED display that enables easy, real-time analysis and adjustment of electrical current requirements for images which are to be shown on the display.

SUMMARY OF THE INVENTION

According to an aspect of an exemplary embodiment of the invention, a method of controlling a discrete LED display is provided. The method includes the steps of opening an electronic file containing a frame of an image to be shown on the display and measuring a commanded brightness for each pixel of the frame of the image. The commanded brightness values are summed and converted to corresponding current values. The corresponding current values are adjusted to arrive at a total estimated current for the frame of the image to be shown on the display. If the total estimated current exceeds a current limit of the display, the brightness value of each pixel is scaled to a final brightness value. The final brightness value corresponds to an adjusted current that is within the current limit. The adjusted current that corresponds to the final brightness value is sent to the display.

Definitions

"Display" means a light-emitting diode (LED) sign that shows images, including static images, prerecorded video images and live video images.

"Discrete display" means a display that is mounted on a vehicle and operates while on the vehicle.

"Large scale discrete display" means a discrete display that is visible from a far distance, such as a display mounted on an airship and visible to viewers on the ground while the ship is airborne.

"Vehicle" means air-based vehicles such as rigid or semi-rigid airships, road-based vehicles such as trucks or cars, and water-based vehicles such as boats.

BRIEF DESCRIPTION OF DRAWINGS

The invention will be described by way of example and with reference to the accompanying drawings, in which.

Similar numerals refer to similar parts throughout the drawings.

DETAILED DESCRIPTION OF THE INVENTION

Figure 1:
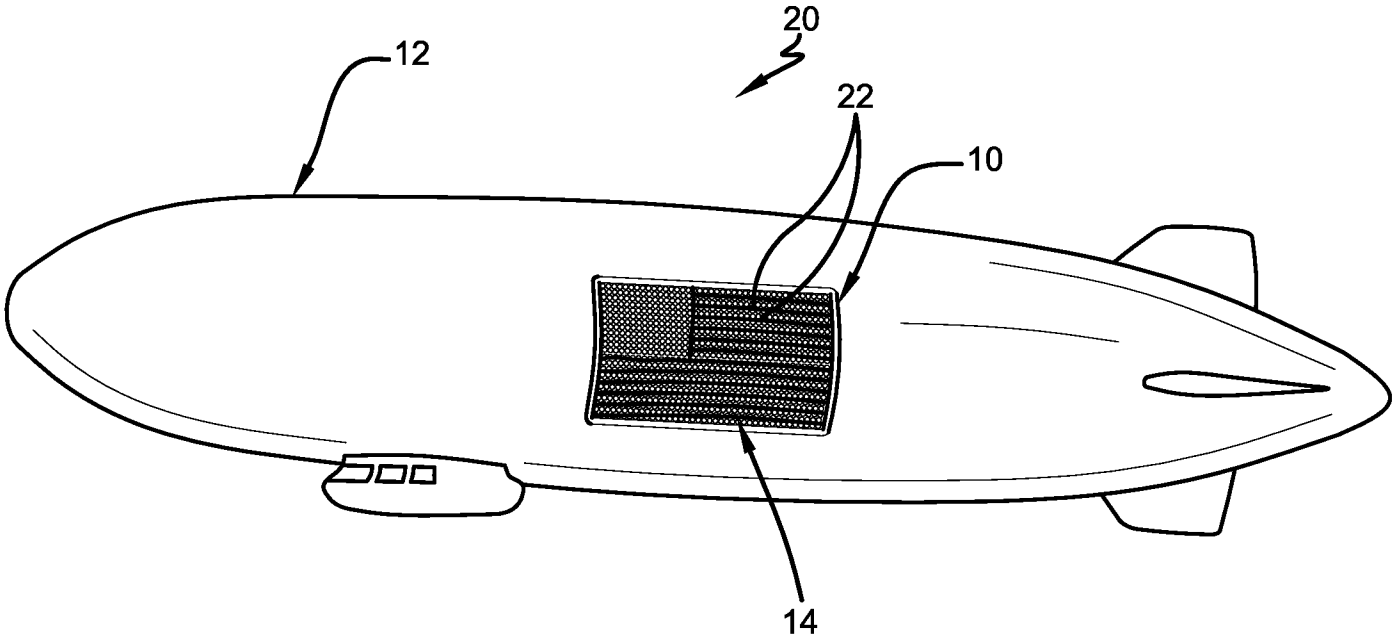
FIG. 1 is a perspective view of a vehicle with a large scale discrete display employing an exemplary embodiment of the present invention.

An exemplary embodiment of a large scale discrete display employing the control method of the present invention is indicated generally at 10, and is shown in FIG. 1 mounted on a vehicle 12. The large scale discrete display 10 shows an image 14. As mentioned above, the vehicle typically has limited electrical current to show the image 14 on the display 10, such as about 150 amps.

Figure 6:
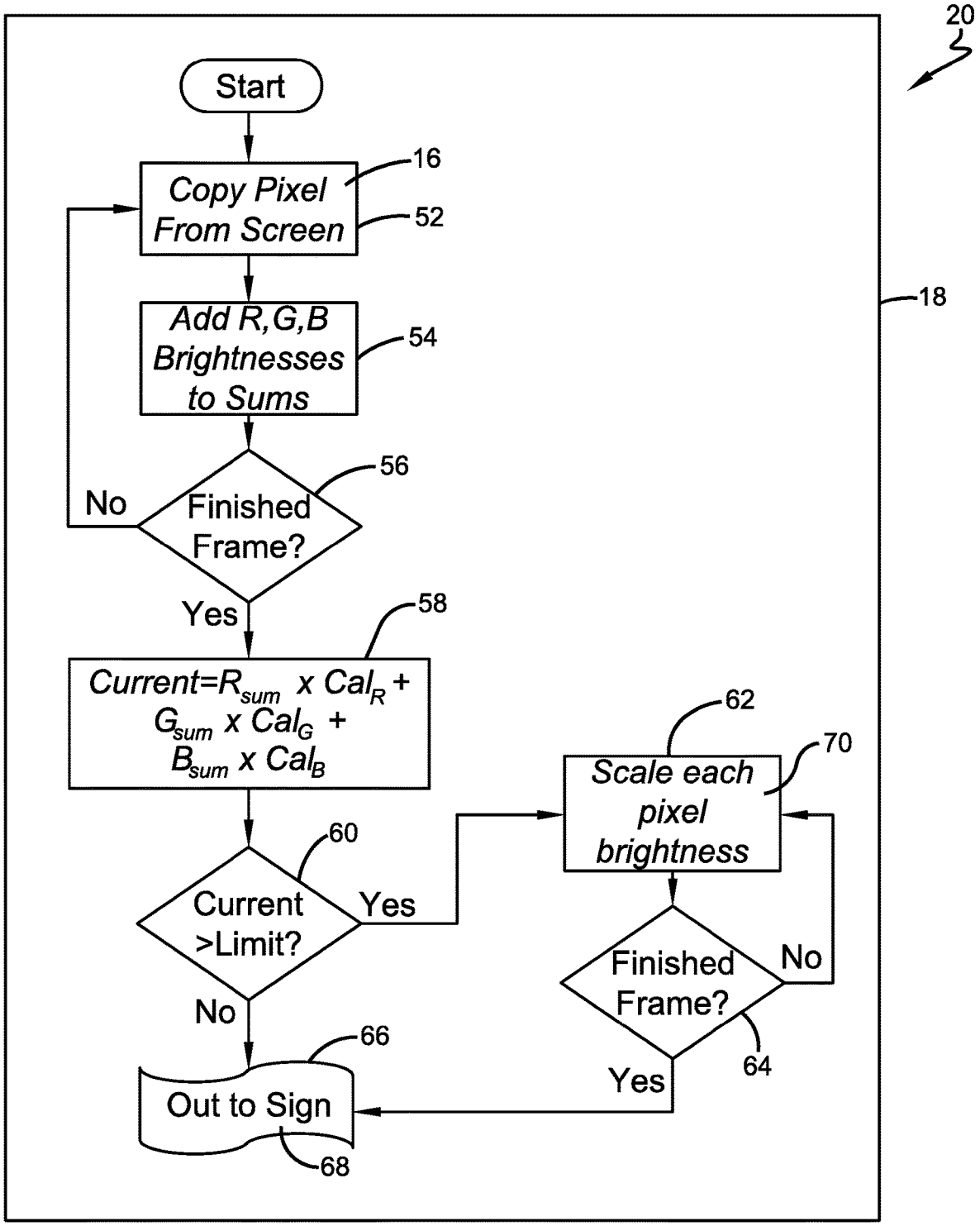
FIG. 6 is a flow diagram showing aspects of steps of an exemplary embodiment of the method of the present invention.

In order to show the image 14 on the display 10, the image is stored in an electronic file 16 (FIG. 6). The electronic file 16 in turn is processed by a system controller 18. The system controller 18 is electronically connected to the display 10, and includes a memory and a processor. The memory and the processor of the system controller 18 store and process data, including the electronic file 16 of the image 14, according to the method of the invention. The method of the invention is indicated generally at 20, and may be stored as a set of software instructions on the memory and executed by the processor of the system controller 18.

Figure 3:
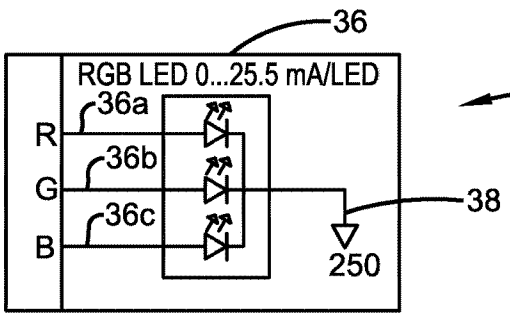
FIG. 3 is a schematic representation of commanded brightnesses in accordance with an exemplary embodiment of the present invention.

The method of the invention 20 includes opening the electronic file 16 containing the image 14 before the image is shown on the display 10. The image 14 is made up of individual frames, and each frame in turn is made up of image pixels 36 (FIG. 3). The display 10 is comprised of individual LED display pixels 22 that compose and thus show each frame of the image 14. For an LED display such as display 10, each display pixel 22 includes the capability to light up at various brightnesses and thus various current levels in red, blue and green colors (FIG. 4), as known in the art. Preferably, the frame of the image 14 is scaled to the display 10 to ensure that each image pixel 36 corresponds to a respective display pixel 22.

Figure 2:
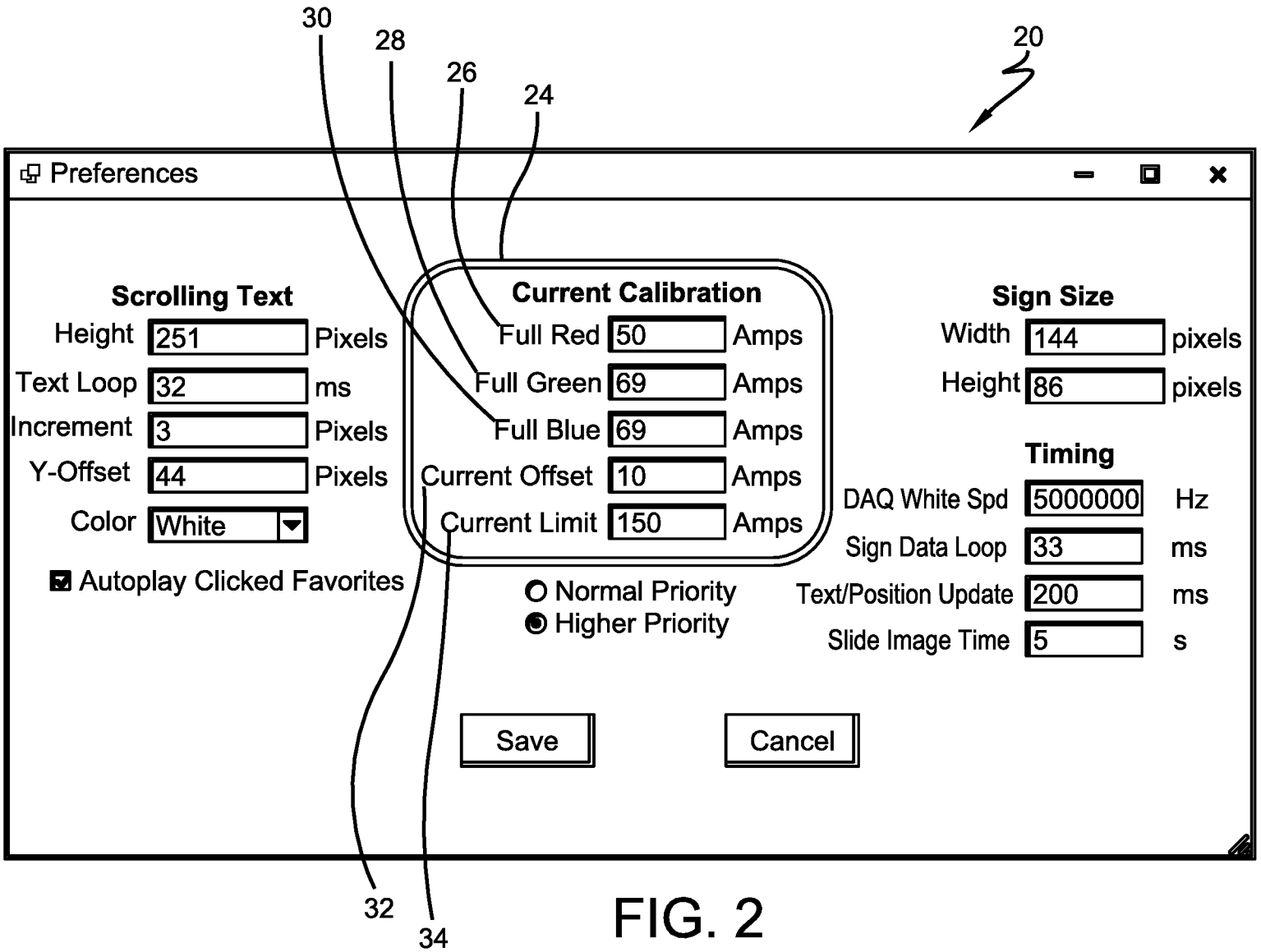
FIG. 2 is a table showing calibration values in accordance with an exemplary embodiment of the present invention.

Turning to FIG. 2, at least once after the construction of the display 10 an initial calibration 24 of the display is performed. The initial calibration 24 includes actuating all of the display pixels 22 to full red brightness and measuring the overall system current with a current measurement device as known to those skilled in the art, such as a current shunt and voltmeter. The total current drawn by the display 10 with full brightness red display pixels 22 is saved as a full red value 26. All of the display pixels 22 are also actuated to full green brightness, and the overall system current is measured with a current measurement device. The total current drawn by the display 10 with full brightness green display pixels 22 is saved as a full green value 28. All of the display pixels 22 are further actuated to full blue brightness, and the overall system current is measured with a current measurement device. The total current drawn by the display 10 with full brightness blue display pixels 22 is saved as a full blue value 30.

All of the display pixels 22 are turned off to generate a full black screen to determine the minimum or offset current required to power the display 10, and the overall system current is measured with a current measurement device. The total current drawn by the display 10 with no illuminated display pixels 22 is saved as a current offset 32. A maximum total current limit 34 is the total amount of current that is available for the display 10, and is a predetermined value, such as about 150 amps. In this manner, the initial calibration 24 is used to determine the calibration values of full red 26, full green 28, full blue 30 and current offset 32, which are stored along with the current limit 34. As mentioned above, the initial calibration 24 is performed at least once after the construction of the display 10, and may optionally be performed at additional time intervals as desired.

Referring now to FIG. 3, after the image 14 is scaled to the display 10, the invention 20 includes measuring an initial desired brightness to show each image pixel 36 of the frame of the image on the display 10, including red 36*a*, green 36*b* and blue 36*c* pixel colors. This initial desired brightness is referred to as the commanded brightness 38 of the image 14. The commanded brightness 38 is measured according to a scale, which by way of example, preferably is from a value of about 0 to a value of about 254.

Figure 4:
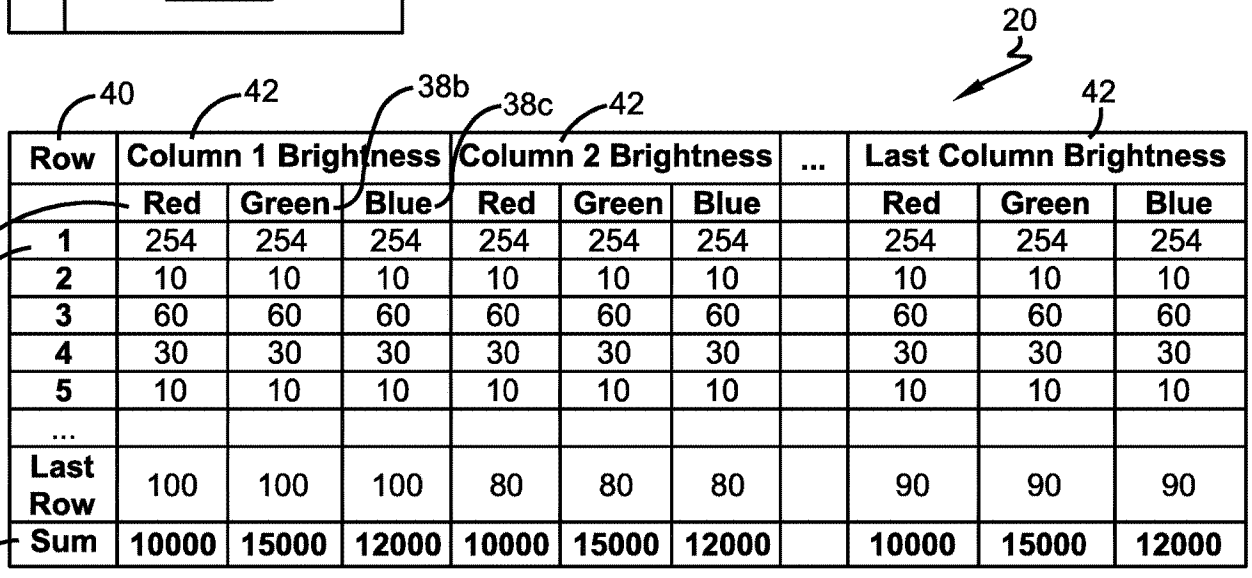
FIG. 4 is a table showing commanded brightness values in accordance with an exemplary embodiment of the present invention.

Turning to FIG. 4, the display 10 includes rows 40 and columns 42 of individual pixels 22 (FIG. 1). As mentioned above, after scaling, each image pixel 36 corresponds to a respective display pixel 22. Before the frame of the image 14 is shown on the display 10, the commanded brightness values 38 for each image pixel 36 of the frame, including red 36*a*, green 36*b* and blue 36*c* pixel colors are mathematically summed, as indicated at 44.

Figure 5:
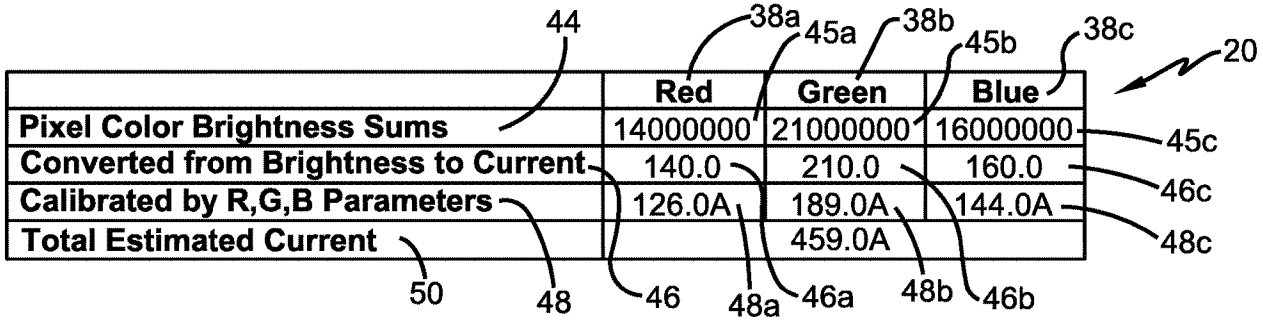
FIG. 5 is a showing summation totals of commanded brightnesses and commanded electrical current in accordance with an exemplary embodiment of the present invention.

As shown in FIG. 5, the sums 44 of the commanded brightness values 38 in red 38*a*, green 38*b* and blue 38*c* colors are totaled to arrive at a total commanded red brightness 45*a*, a total commanded green brightness 45*b* and a total commanded blue brightness 45*c* for the frame of the image 14. The respective total commanded brightness values are converted to a current 46. More particularly, the total commanded red brightness 45*a* is converted to a commanded red current 46*a*. the total commanded green brightness 45*b* is converted to a commanded green current 46*b*, and the total commanded blue brightness 46*c* is converted to a commanded blue current 46*c*.

Each respective commanded current 46 may be adjusted to arrive at a calibrated current 48. More particularly, the commanded red current 46*a* may be adjusted using the calibration values described above to arrive at a red calibrated current 48*a*, the commanded green current 46*b* may be adjusted using the calibration values to arrive at a green calibrated current 48*b*, and the blue commanded current 46*c* may be adjusted using the calibration values to arrive a blue calibrated current 48*c*. The red calibrated current 48*a*, the green calibrated current 48*b* and the blue calibrated current 48*c* are totaled to yield a total estimated current 50, which is the current that is desired to show the frame of the image 14 on the display 10.

If the total estimated current 50 exceeds the current limit 34, all image pixels 36 for the frame of the image are electronically scaled down proportionally so as not to exceed the current limit. To scale down the image pixels 36, each commanded brightness value 38 is multiplied by a ratio that is the inverse of the amount by which the total estimated current 50 exceeds the current limit 34. For example, if the total estimated current 50 is 125 percent (%) of the current limit 34, the commanded brightness value 38 for each image pixel 36 is scaled by a ratio of 100/125 or 1/1.25, which is percent. It is to be understood that the scaling of the commanded brightness value 38 may be by linear, exponential, logarithmic or other ratios, as a fixed or weighted percentage, or other technique known to those skilled in the art.

The commanded brightness value 38 of each image pixel 36 is thus proportionally reduced to a final brightness value 70 (FIG. 6), which yields a corresponding adjusted current 68 that is at or below the current limit 34. The processor 18 permits the current 68 that corresponds to the final brightness value 70 to be sent to the display 10 to show the frame of the image 14 within the current limit 34.

If the total estimated current 50 does not exceed the current limit 34, the image pixels 36 for the frame of the image do not need to be electronically scaled down. In such a case, the commanded brightness value 38 of each image pixel 36 is the final brightness value 70 and the processor 18 permits the current 68 that corresponds to the final brightness value to be sent to the display 10 to show the frame of the image 14.

Turning to the flow diagram of FIG. 6, the above-described current calculations and brightness scaling of the steps of the method of the invention 20 are summarized. Before the frame of the image 14 is shown on the display 10, the electronic file 16 for the frame of the image is processed by the controller 18, step 52. The commanded brightness 38 (FIG. 3) for each image pixel 36 is measured and the brightness values are summed 44 (FIGS. 4 and 5), step 54. Once the task is completed for a given frame, step 56, the total estimated current 50 for the frame is calculated (FIG. 5), step 58.

As described above, if the total estimated current 50 exceeds the current limit 34, step 60, all image pixels 36 in the frame are scaled down proportionally so as not to exceed the current limit, step 62. After verifying that the scaling has been completed for a given frame, step 64, the processor 18 permits the current 68 that corresponds to the final brightness value 70 to be sent to the display 10 to show the frame of the image 14, step 66. Steps 52 through 66 are repeated for each frame of the image 14 that is to be shown on the display 10, before each respective frame is shown. For example, when the image 14 is a video file, steps 52 through 66 may be repeated at a frequency of about thirty (30) times per second.

In this manner, the method of the invention 20 provides real-time scaling of the brightness of each video frame of the image 14 that is shown on the display 10 so that the vehicle 12 will not experience overcurrent. The method 20 includes steps for estimating the current of every frame of the image 14 on a frame-by-frame basis in real time and controlling the brightness of individual image pixels 36 of the frame of the image. The pixel values are dynamically adjusted when necessary to maintain the required electrical current for the display 10 within acceptable limits.

The method 20 is performed before the image 14 is shown on the display 10, and preferably is automated for ease of use. By being automated, the method does not require time-consuming or cumbersome user intervention or user-executed manual steps, as was done in the prior art. In addition, the calibration and scaling of the method 20 makes the electrical current estimates more accurate and allows flexibility for varying systems and environments. The image 14 may be a graphic, a video file or a live video feed. The electronic file for any type of image 14, including live feed, is analyzed according to the method of the invention 20, and if the electrical current requirement is greater than what is available on the vehicle 12, the brightness of each frame of the image is reduced proportionally to ensure that the current is within available limits.

It is also to be understood that the structure and method of the above-described discrete LED display control may be altered or rearranged, or components or steps known to those skilled in the art omitted or added, without affecting the overall concept or operation of the invention.

The invention has been described with reference to a preferred embodiment. Potential modifications and alterations will occur to others upon a reading and understanding of this description. It is to be understood that all such modifications and alterations are included in the scope of the invention as set forth in the appended claims, or the equivalents thereof.

What is claimed is:

1. A method of controlling a discrete LED display, comprising the steps of:

performing an initial calibration of the display, including turning off all pixels in the display simultaneously to generate a full black screen, measuring the current required to power the display, and saving the current required to power the display with all pixels turned off as a current offset;

opening an electronic file containing a frame of an image to be shown on the display;

analyzing the electronic file by measuring a commanded brightness for each pixel of the frame of the image;

summing values of the commanded brightnesses, including summing total brightness values for all red pixels, all green pixels and all blue pixels of the frame of the image, without summing brightness gains;

converting the summed brightness values to corresponding current values;

adjusting the corresponding current values to a total estimated current for the frame of the image to be shown on the display;

if the total estimated current exceeds a current limit of the display, scaling the brightness value of each pixel to a final brightness value, wherein all of the pixels of the frame of the image are scaled at the same proportion, and wherein the final brightness value corresponds to an adjusted current that is within the current limit; and sending the adjusted current that corresponds to the final brightness value to the display.

2. The method of controlling a discrete LED display of claim 1, wherein the step of converting the summed total brightness values to corresponding current values includes converting the sum of the total brightness values for all red pixels to a commanded current for all red pixels, converting the sum of the total brightness values for all green pixels to a commanded current for all green pixels, and converting the sum of the total brightness values for all blue pixels to a commanded current for all blue pixels.

3. The method of controlling a discrete LED display of claim 2, wherein the step of adjusting the corresponding current values to a total estimated current includes adjusting the commanded current for all red pixels to arrive at a calibrated red pixel current, adjusting the commanded current for all green pixels to arrive at a calibrated green pixel current, and adjusting the commanded current for all blue pixels to arrive at a calibrated blue pixel current.

4. The method of controlling a discrete LED display of claim 3, wherein the step of adjusting the corresponding current values to a total estimated current includes totaling the calibrated red pixel current, the calibrated green pixel current and the calibrated blue pixel current to arrive at the total estimated current.

5. The method of controlling a discrete LED display of claim 1, wherein the step of scaling the brightness value of each pixel to a final brightness value includes multiplying each brightness value by a ratio that is the inverse of the amount by which the total estimated current exceeds the current limit.

6. The method of controlling a discrete LED display of claim 1, wherein the value of each commanded brightness is a multiple of the commanded current.

7. The method of controlling a discrete LED display of claim 1, wherein the value of each commanded brightness is from about 0 to about 254.

8. The method of controlling a discrete LED display of claim 1, wherein the step of performing an initial calibration of the display includes actuating all red pixels of the display to full brightness, measuring the current drawn by the red pixels, saving the value of the current drawn by the red pixels, actuating all green pixels of the display to full brightness, measuring the current drawn by the green pixels, saving the value of the current drawn by the green pixels, actuating all blue pixels of the display to full brightness, measuring the current drawn by the blue pixels, and saving the value of the current drawn by the blue pixels.

9. The method of controlling a discrete LED display of claim 1, wherein the step of opening an electronic file occurs before the image is shown on the display.

10. The method of controlling a discrete LED display of claim 1, wherein the steps of opening an electronic file, measuring a commanded brightness, summing values of the commanded brightnesses, summing values of the commanded brightnesses, converting the summed brightness values, adjusting the corresponding current values to a total estimated current, scaling the brightness value of each pixel to a final brightness value, and sending the final current to the display are repeated for each frame of an image to be shown on the display.

11. The method of controlling a discrete LED display of claim 1, further comprising the step of scaling the frame of the image so that each image pixel corresponds to a respective display pixel.

12. The method of controlling a discrete LED display of claim 1, wherein the discrete LED display is a large scale discrete display mounted on a vehicle.

13. The method of controlling a discrete LED display of claim 12, wherein the vehicle is an airship.

* * * * *